US005855756A

United States Patent [19]

Anzalone, III

[11] Patent Number: 5,855,756

[45] Date of Patent: Jan. 5, 1999

[54] METHODS AND APPARATUS FOR ENHANCING ELECTROREFINING INTENSITY AND EFFICIENCY

[75] Inventor: Gerald C. Anzalone, III, Oracle, Ariz.

[73] Assignee: BHP Copper Inc., Tucson, Ariz.

[21] Appl. No.: 752,757

[22] Filed: Nov. 20, 1996

Related U.S. Application Data

[63] Continuation of Ser. No. 563,481, Nov. 28, 1995, abandoned.

[51] Int. Cl.[6] ..... C25C 1/12

[52] U.S. Cl. ..... 205/334; 205/574; 204/269; 204/275

[58] Field of Search ..... 205/334, 574; 204/269, 275

[56] References Cited

U.S. PATENT DOCUMENTS

| | | | |
|---|---|---|---|
| 315,265 | 4/1885 | Farmer | 204/232 |
| 1,932,160 | 10/1933 | Hills | 204/269 |
| 2,350,669 | 6/1944 | Boller | 204/237 |
| 2,515,614 | 7/1950 | Schumacher | 204/274 |
| 3,405,051 | 10/1968 | Crane | 204/269 |
| 3,558,455 | 1/1971 | Soresen et al. | 205/574 |
| 3,558,466 | 1/1971 | Lebrizzi | 204/275 |
| 3,682,809 | 8/1972 | Marquardson | 204/275 |
| 3,956,086 | 5/1976 | Wilkinson et al. | 205/348 |
| 3,966,567 | 6/1976 | Pace et al. | 205/353 |
| 4,098,668 | 7/1978 | Andersen et al. | 204/237 |
| 4,196,069 | 4/1980 | Mose et al. | 204/257 |
| 4,581,115 | 4/1986 | Holzer | 204/275 |
| 4,773,983 | 9/1988 | Shyu | 204/273 |
| 5,282,934 | 2/1994 | Cox | 205/335 |

FOREIGN PATENT DOCUMENTS

| | | |
|---|---|---|
| 696941 | 11/1964 | Canada . |
| 736957 | 12/1932 | France . |
| 1305790 | 2/1963 | France . |
| 1 132 341 | 10/1960 | Germany . |
| 23 32 605 | 1/1975 | Germany . |
| 47 9881 | 3/1972 | Japan . |
| 289550 | 11/1967 | U.S.S.R. . |
| 636948 | 12/1946 | United Kingdom . |

*Primary Examiner*—John Niebling
*Assistant Examiner*—Brendan Mee
*Attorney, Agent, or Firm*—Snell & Wilmer

[57] ABSTRACT

An electrorefining cell permits increased electrolyte flow rates while maintaining the slime layer at the bottom of the cell and on the anode faces substantially intact. The cell includes an inlet manifold located near the bottom of the cell and having a plurality of discharge orifices for the electrolyte solution. An inlet baffle shrouds the discharge orifices to regulate and direct the flow of electrolyte solution within the cell. The inlet baffle and the cell wall form an elongated slot that resides beneath the surface of the electrolyte solution. An analogous configuration is employed for electrolyte discharge to enable relatively high electrolyte flow into and out of the cell. The specific shape, size, and location of the inlet baffle and an outlet baffle may be selected to optimize the electrolyte flow characteristics of the cell.

24 Claims, 4 Drawing Sheets

METHODS AND APPARATUS FOR ENHANCING ELECTROREFINING INTENSITY AND EFFICIENCY

This is a continuation of application Ser. No. 08/563,481 filed Nov. 28, 1995, abandoned.

TECHNICAL FIELD

The present invention relates, generally, to electrochemical cells and more particularly to such cells as are used to plate metal from an impure anode to a substantially pure cathode with an aqueous electrolyte containing plating reagents, including an improved hydraulic system for optimizing the rate of flow and the distribution of electrolyte through the cell.

BACKGROUND ART OF THE INVENTION

Methods and apparatus for extracting metals from mined ore are generally well known. Metallurgical processes have been developed which, through a series of concentration steps, produce substantially pure metal suitable for use in final applications. For instance, copper ore typically contains minerals comprised of copper, sulfur, iron and oxygen, with the total content of copper rarely exceeding 5%. Through a series of metallurgical processes, high purity copper (99.997% and higher) is produced. The final process employed in this series is eletrorefining, in which a relatively impure copper anode is dissolved into an aqueous electrolyte through the application of electrical current. The dissolved copper is then deposited onto another surface to form high purity copper cathode. The tank in which this occurs is commonly referred to as an electrorefining cell.

Mature electrorefining techniques have emerged to meet the demand for large volumes of highly pure metals, particularly copper. In a typical electrorefining cell, a plurality of "impure" (e.g. 99.6%) copper anodes are interleaved among respective cathode plates upon which high purity copper is deposited. The impurities in the anode typically include, inter alia, gold, silver, selenium, tellurium, lead, bismuth, nickel, arsenic as well as mold release agents used to facilitate the removal of anodes from molds at the conclusion of the casting process.

An aqueous electrolyte fills and flows through the cell while a voltage differential is applied to the anodes vis-a-vis the cathodes. Typical aqueous electrolytes contain plating reagents to ensure a flat smooth cathode deposit, an important measure of cathode quality. In the process, insoluble anode constituents form a layer on the anode face; as refining progresses, some of this material then falls off and generally sinks to the bottom of the refining cell. Soluble species dissolved from the anode either stay in solution in the aqueous electrolyte or form precipitates which adhere to the layer on the anode face, or sink to the bottom of the cell. The solids, comprised of insoluble anode constituents and precipitated compounds are commonly referred to as "slimes" and are typically collected as a slurry in the bottom of the cells.

By carefully controlling the various process parameters associated with the electrorefining process, extremely pure metal cathodes may be obtained. The cost associated with constructing and operating large electrorefining facilities are, however, substantial. Hence, it is desirable to maximize the rate of production of high quality cathodes from an electrorefining facility.

The rate at which copper is dissolved from anodes and replated at the cathodes is directly proportional to the amount of electrical current applied to the cathodes and anodes in the electrorefining cell. The intensity of the applied current is commonly expressed as current density, typically having units of amperes per square meter. Hence, the cathode production rate from any given electrorefining cell may be increased by increasing the current density. However, there are practical limitations to increasing current density; lower quality cathodes are produced if the current density is increased beyond the capabilities of the technology employed.

The quality of the cathode is a function of, inter alia, the concentration of reagents in the electrolyte filling the volume between each anode and cathode. More particularly, it is desirable to ensure a substantially uniform reagent concentration throughout the entire electrolyte volume surrounding the anodes and cathodes within an electrorefining cell. The formation of a dense, smooth and flat cathode deposit is required to maintain the quality of the cathode and the efficiency of the process. Efficiency is lost when an irregular deposit is formed that causes the anode and cathode to make physical contact. When this occurs, current flows through the point of contact rather than causing the dissolution of anode and deposition of cathode. The energy consumed by this short circuit is wasted as heat in the electrolyte.

The temperature of the electrolyte within the cell also tends to influence the quality of the finished cathodes. Electrolyte is typically heated to 57°–68° C. to improve, inter alia, the conductivity of the electrolyte, the rate at which reactions occur in the cell and the viscosity of the electrolyte. Operating at increased temperatures generally has a salutary effect on the quality of the cathode produced and can also reduce the unit cost of production. Ideally, the temperature of the electrolyte would be uniform throughout the electrorefining cell, however, common electrolyte flow rates and delivery methods are inadequate and the temperature of the electrolyte can be several degrees different from one location to another within the cell. The consumption of reagents is also related to the temperature of the electrolyte; some of the reagents used tend to degrade and become less effective more rapidly at higher temperatures. Rapid degradation coupled with non-uniform distribution of electrolyte tends to result in lower quality cathode.

The purity of cathode is also a function of the amount of slimes occluded in the cathode during refining. Slimes occlusion occurs when particles of slimes that have broken off from the layer surrounding the dissolving anode become suspended in the electrolyte and migrate to the surface of the cathode. Copper is plated around and over the particle, thereby effectively incorporating the impurities comprising the particle into the mass of the cathode. Preferably these impurities sink to the bottom of the cell, thereby removing them from the active plating region and eliminating the possibility of them becoming incorporated into the cathode deposit.

The profitability of an electrorefining facility is inter alia, a function of the production rate of the facility, i.e., the rate at which pure cathodes are produced. As stated above, the rate of deposition of cathode is essentially a linear function of the amount of current applied to the anodes and cathodes. However, in order to ensure high cathode quality, substantially uniform reagent distribution and substantially uniform temperature must be maintained within the cell. Both of these parameters require a sufficient flow rate of electrolyte through the system to ensure adequate and uniform supply of plating reagents to the entire active area of each cathode, while reducing the residence time of the electrolyte within the cell and, hence, reducing the temperature drop of the electrolyte while resident in the cell.

Accordingly, it can be said that the intensity of the current density which may be properly applied to the electrodes depends on the ability of the system to provide a sufficient electrolyte flow rate and uniform reagent and temperature distribution throughout the cell to maintain high quality cathode production. However, the electrolyte flow rate may typically not be increased to the point where the slimes are disturbed; if the slime at the bottom of the cell or on the anode face is disrupted, the impurities which comprise the slime may be plated onto the cathode, dramatically compromising cathode quality.

A flow rate on the order of 5 to 10 gallons per minute (GPM) has evolved as the standard in the electrorefining industry. This flow rate is generally viewed as providing acceptable reaction times and adequate reagent delivery, while not unnecessarily disturbing the slime. In this regard, it is noted that flow rates in known electrowinning processes often approach 50 to 60 GPM, inasmuch as electrowinning processes typically do not involve the formation and accumulation of slimes; hence, turbulent, high velocity aqueous flow in electrowinning systems does not produce the same quality problems typically encountered in an electrorefining context.

Presently known electrorefining systems typically involve an electrolyte inlet port disposed at one end of the refining cell and an electrolyte discharge port disposed at the opposite end of the refining cell. These ports are typically configured as orifices of circular cross-section, of sufficiently large diameter to permit gravity pumping of the solution through the cell along a flow path generally perpendicular to the planes of the electrodes. By maintaining flows in the range of 5 to 10 GPM, the slime is kept from suspending in the electrolyte, resulting in substantially pure cathodes. However, inasmuch as the magnitude of the current density which drives the reaction is limited by the electrolyte flow rate, aggregate cathode production remains limited by the rate at which electrolyte may be uniformly pumped through the system.

A technique for enhancing the production of highly pure cathodes is thus needed which overcomes the shortcomings of the prior art.

SUMMARY OF THE INVENTION

An improved electrorefining cell is provided which overcomes the shortcomings of the prior art. In accordance with one aspect of the present invention methods and apparatus are provided which permit increased electrolyte flow rates through the electrochemical cell while maintaining the slime layer at the bottom of the cell and on the anode face substantially intact.

In accordance with a preferred embodiment of the present invention, an electrolyte inlet manifold is provided which substantially spans the length of the cell near the bottom of a lengthwise side of the cell. The electrolyte inlet manifold comprises a plurality of inlet orifices through which the electrolyte is pumped. In accordance with a further aspect of a preferred embodiment of the present invention, a baffle is provided which shrouds the inlet orifices such that localized regions of high velocity electrolyte flow are substantially contained within the baffle. In this preferred embodiment, the baffle and the cell wall comprise an elongated slot within which the inlet manifold is disposed. As a result, substantially higher flow rates may be achieved while minimizing turbulence and localized velocity fluctuations, thereby permitting high flow rates through the cell without disturbing the slime layer. In accordance with this embodiment a similarly configured discharge manifold/baffle arrangement is suitably provided along the opposite wall of the cell for facilitating uniform velocity, high-flow electrolyte discharge from the cell.

In accordance with a further aspect of the present invention, substantially uniform reagent distribution is achieved, thus permitting higher current densities to be employed in the context of existing cell configurations without compromising cathode quality. As a result of the higher electrolyte flow rates achievable in the context of this aspect of the present invention, electrolyte residence time within the cell is reduced, decreasing temperature fluctuations within the cell. This further enhances the quality of the cathodes while permitting higher aggregate cathode production per unit of time.

BRIEF DESCRIPTION OF THE DRAWING FIGURES

The subject invention will hereinafter be described in conjunction with the appended drawing figures, wherein like numerals denote like elements, and:

DETAILED DESCRIPTION OF PREFERRED EXEMPLARY EMBODIMENTS

Figure 1:
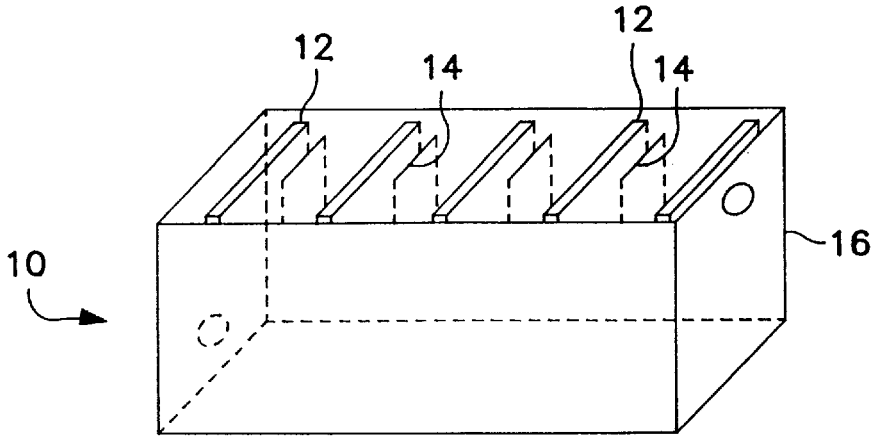
FIG. 1 (PRIOR ART)
FIG. 1 is a schematic diagram of a prior art electrorefining cell, showing an alternating series of anode and cathode plates.
Figure 2:
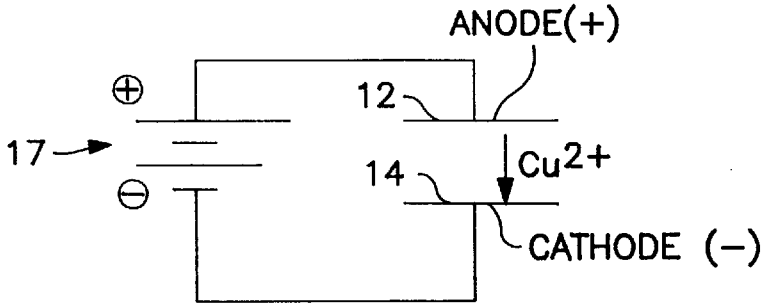
FIG. 2 is a schematic circuit diagram of a typical electrode pair.

Referring now to FIG. 1, an electrorefining system 10 suitably comprises a cell 16 having disposed therein an alternating series of anodes 12 and cathodes 14. For clarity, the electrodes are illustrated schematically in FIG. 2. It will be appreciated, however, that virtually any convenient number of electrodes may be employed in a particular cell, and that a plurality of cells may be grouped closely together to thereby share a common electrical system, hydraulic system, and/or the like. Typically, cell 10 includes forty-six anodes 12 and forty-five cathodes 14 such that pure copper is evenly deposited on both surfaces of each cathode 14.

Figure 3A:
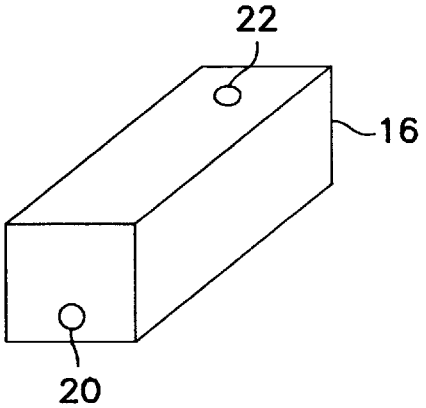
FIG. 3A (PRIOR ART)
FIG. 3A is a schematic diagram of a typical prior art electrolyte inlet and electrolyte discharge port configuration.
Figure 3B:
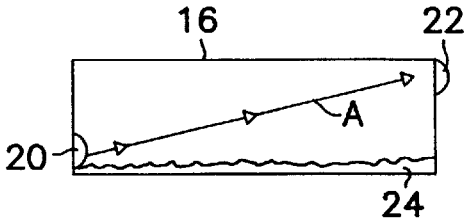
FIG. 3B (PRIOR ART)
FIG. 3B is a side view of the diagram of FIG. 3A.

With reference to FIGS. 1 and 3, a stable aqueous electrolyte solution is suitably pumped into an inlet port 20, through cell 16, and discharged from a discharge port 22, such that the flow path generally follows arrow A (See FIG. 3B). More particularly, the aqueous electrolyte suitably comprises one or more species of plating reagents, for example thiourea, animal protein, and/or chloride.

With reference again to FIG. 2, a current source 17, typically external to and remote from cell 16, is employed to establish an electrical current through the cathodes 12 and anodes 14, for example in the range of 200 to 350 amperes per square meter and preferably about 300 $A/m^2$. The potential of the cell operating in this range of current densities is typically 0.24 to 0.3 volts. With the applied potential driving the electrochemical reaction, cupric ions ($Cu^{2+}$) are carried through the electrolyte from the respective anode surfaces to the respective cathode surfaces, thereby depositing pure copper onto the respective cathode surfaces. During the process, impurities embodied in the anodes are liberated from the anode aggregate forming a layer of slime 24 (FIG. 3B) typically on the bottom of cell 16. To ensure that highly pure cathodes are produced, system parameters are advantageously maintained such that slime layer 24 is not disrupted, and that the impurities which comprise slime 24 do not become suspended in the solution.

The profitability of an electrorefining facility is a function of, among other things, the weight of highly pure copper cathode which can be produced per unit of time. To increase this production rate, it is desirable to increase the ion flux from each anode to each cathode; since the rate of ion flow is directly proportional to the magnitude of the applied current density, a higher rate of production of finished cathodes may be achieved by employing a higher current density.

In order to support higher current densities, it is desirable to supply a sufficient quantity of plating reagent to the entire surface of each electrode within the cell. Moreover, to ensure uniform deposition with a resulting flat finished cathode surface, it is desirable to provide a uniform plating reagent concentration within the entire cell. As the applied current density and, hence, the resulting ion flux increases, the rate at which the plating reagents are consumed also increases. It is therefore desirable to supply sufficient reagent via a higher flow rate (rather than increased reagent concentration due to the deleterious effects of excessive reagent) to each electrode in the electrorefining cell. As discussed above, a higher electrolyte flow rate also results in decreased residence time of the electrolyte within the cell, further enhancing temperature control and minimizing temperature drop in the electrolyte from the inlet port to the discharge port.

Increasing electrolyte flow rate impacts several factors on the quality of the finished cathodes. In the first instance, the velocity of electrolyte flow at the anode surface should be advantageously controlled such that the fluid forces created by the flowing electrolyte do not overcome the cohesive force with which slime is bound to the anode surface. If this cohesive force is broken by fluid flow, or if the velocity of fluid flow is otherwise sufficient to overcome the gravitational forces which would otherwise draw slime particles to the bottom of the cell, it is possible that impurities liberated from the anode may traverse the gap between the anode and cathode and become embedded in the cathode surface. The resulting cathode impurity degrades the quality of the finished cathode.

Secondly, reagents naturally break down following introduction into the electrolyte so that while the electrolyte is resident in the cell, the reagents become less effective. The greater the amount of time required to traverse from the inlet port to the outlet port, the greater the amount of reagent degradation and the more likely cathode quality will suffer. Due to the differential reagent concentration from cell inlet to outlet typically encountered in the prior art, reagent dosage and concentration should be adjusted to ensure that there is sufficient reagent in the electrolyte at the discharge of the cell to impart the desired effect at the cathodes located adjacent to the discharge. This can lead to excessively high concentrations of reagent at the inlet, having deleterious effects on the quality of the cathode nearest the inlet. Hence, it is advantageous to minimize the time the electrolyte is resident in the cell such that the concentration differential is reduced and cathode quality is consistent, regardless of the position of the cathode within the cell.

A third factor associated with high velocity electrolyte flow surrounds the disturbance of slime layer 24 at the bottom of cell 16. As discussed above, slime layer 24 is advantageously left undisturbed during the plating process. High velocity electrolyte flow tends to disrupt the slime layer, causing the particles comprising the slime to be suspended into solution or otherwise drawn near the surface of a cathode. To the extent any of the particles comprising slime 24 are incorporated into a cathode, cathode purity and hence quality is diminished.

Figure 4A:
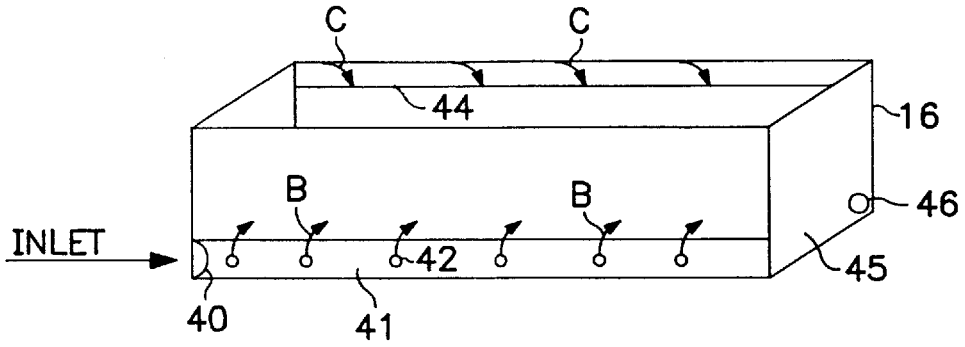
FIG. 4A is a schematic perspective view of a preferred embodiment of the present invention, showing an inlet manifold.
Figure 4B:
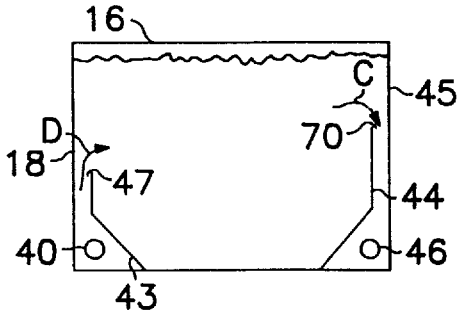
FIG. 4B is an end view of the cell shown in FIG. 4A, showing an inlet baffle and a discharge baffle.

Referring now to FIGS. 4A and 4B, an improved electrolyte hydraulic system in accordance with the present invention suitably comprises an inlet port 40 which communicates with an inlet manifold 41. Inlet manifold 41 suitably comprises a plurality of discharge orifices 42 disposed along the length thereof. As electrolyte is pumped into inlet port 40, the electrolyte substantially uniformly flows through respective orifices 42, as shown in FIG. 4A by respective arrows B.

With reference to FIG. 4B, a baffle 43 suitably extends along at least a portion of the length of manifold 41, preferably along substantially the entire length thereof. Baffle 43 and a side wall 18 of cell 16 suitably define an elongated slot 47 through which electrolyte is supplied to the interior of cell 16 (along arrow D in FIG. 4B).

The electrolyte which enters cell 16 through slot 47 is suitably discharged from cell 16 through a suitable discharge assembly. More particularly, an elongated discharge manifold 46, for example one which is analogous to inlet manifold 41, suitably comprises a plurality of discharge orifices (analogous to inlet orifices 42) and communicates with a discharge port 45 from which electrolyte is drawn from cell 16.

A baffle 44 advantageously shrouds the discharge manifold in much the same way that inlet baffle 43 shrouds inlet manifold 41, discussed above. In accordance with a preferred embodiment of the present invention, the upper edge of baffle 44 suitably forms an elongated slot 70 with a side wall 45 of cell 16. As seen in FIG. 4B, the electrolyte generally flows along arrow C through slot 70 and out of cell 16. By extending baffle 44 to thereby position slot 70 in the upper region of the cell, a left-to-right, generally upward electrolyte flow path is established from slot 47 to slot 70 (see FIG. 4B). In this way, a substantially uniform flow of electrolyte is achieved throughout the cell, in an orientation which is substantially parallel to the opposing electrode surfaces.

The foregoing manifold/baffle configurations provide several important advantages in the context of the present invention. For example, substantially higher flow rates may be achieved while controlling the electrolyte fluid velocity at acceptable levels. This results from, inter alia, the relatively large cross-sectional area of the inlet and discharge slots vis-a-vis prior art systems.

Figure 5:
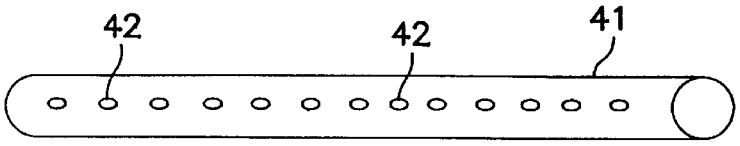
FIG. 5 is a side elevation view of an exemplary inlet manifold in accordance with the present invention.

More particularly and with reference now to FIG. 5, inlet manifold 41 (and/or the discharge manifold) suitably comprises an elongated tube (pipe), for example of generally a substantially circular cross-section, having an inner diameter which is sufficiently large to permit flow rates up to several hundred GPM while using conventional gravity pumping mechanisms. In a preferred embodiment, the inner diameter of pipe 42 is suitably in the range of about 0.25 to about 5 in., and preferably on the order of about 1 to about 2 in., and most preferably about 1.5 in. The length of pipe 41 is suitably determined in accordance with the length of cell 16; in a preferred embodiment, pipe 41 is suitably on the order of about 6 to about 20 feet long, and preferably about 16 feet long.

Respective orifices 42 are suitably on the order of about 0.125 to about 1 in. in diameter, and preferably about 0.25 to about 0.5 inches in diameter, and most preferably approximately about 0.375 inches in diameter. The number and spacing of orifices 42 are shown schematically in FIG. 5; in a preferred embodiment, fifteen respective orifices 42 are employed, with each orifice 42 being spaced approximately 12 inches from one another, with the terminal orifices being disposed approximately 6 inches from each end of pipe 41.

Many different factors influence the design and arrangement of manifold 41 and its associated baffle, including the desirability of having substantially uniform pressure and velocity for each of respective orifices 42. In addition, in accordance with one aspect of a preferred embodiment, the total surface area of orifices 42 is suitably in the range of and preferably slightly less than the cross-sectional area of pipe 41. In the illustrated embodiment, for example, the cross-sectional area ($A=\pi(D/2)^2$) of pipe 41 is approximately 1.77 in.$^2$, whereas the total aggregate surface area of orifices 42 is on the order of 1.66 in.$^2$ ($15\times\pi(D/2)^2$). In the context of this description, the "surface area" of a given orifice means the aperture area defined by the orifice itself or the area bounded by the perimeter of the orifice.

The physical dimensions of discharge manifold 46 are suitably on the order of those discussed above with respect to inlet manifold 41. In a preferred embodiment, slightly larger flow path areas are employed in discharge manifold 46 than in the inlet manifold 41, resulting in slightly less resistance to flow through the discharge manifold. In a preferred embodiment, a 3 inch inner diameter discharge tube (pipe) 46 is used, with 15 discharge orifices substantially evenly spaced apart along the length the discharge manifold, each orifice being on the order of 0.8125 inches in diameter.

Although the embodiments shown in FIGS. 4A and 4B are set forth in the context of a manifold evidencing substantially evenly spaced orifices baffled by an elongated shroud, it will be appreciated that any geometric configuration may be employed which provides relatively high aqueous flow rates while at the same time affording relatively low and/or substantially uniform fluid velocities. Thus, any suitable fluid inlet and discharge configuration may be employed, including a plurality of spaced-apart jets, nozzles, and the like. Moreover, the inlet and discharge mechanisms may be oriented in virtually any manner which permits high fluid flow rates with low localized and/or uniform velocities, including a vertically oriented slot, for example.

Figure 6:
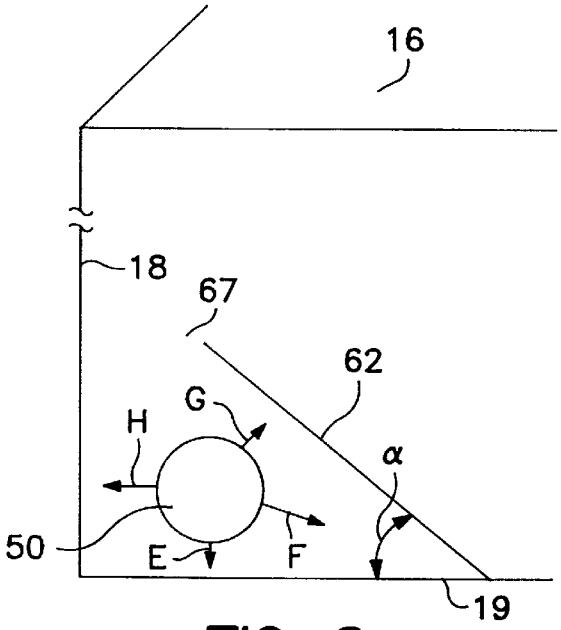
FIG. 6 is a schematic end view of an alternative embodiment of an electrorefining system in accordance with the present invention.

Referring now to FIGS. 6–9, some of the many alternative embodiments of inlet and discharge configurations embraced within the present invention are shown. With particular reference to FIG. 6, one alternate inlet configuration (or discharge configuration (not shown)) comprises an elongated inlet manifold 50 (shown in cross-section) suitably disposed proximate an angled baffle 62. In accordance with this embodiment, baffle 62 is suitably oriented with respect to one surface (e.g., the bottom 19) of cell 16 at an angle $\alpha$. Baffle 62, like baffle 44, suitably shrouds manifold 50 and forms a slot (opening) 67 with respect to side 18. Preferably, angle $\alpha$ is within about 10° to 90°0 with respect to bottom 19, and more preferably within about 30° to about 60°. Angle $\alpha$ may be fixed or dynamically reconfigurable.

Virtually any convenient mechanism for facilitating fluid flow from manifold 50 into cell 16 may be employed. For example, slots, holes, and/or other apertures extending through the surface of manifold 50 may be suitably employed. Similarly, while the inlet orifices of manifold 50 may be directed toward slot 67, it may be advantageous to orient the inlet orifices such that the electrolyte which flows out of inlet manifold 50 is directed toward the bottom of cell 16 (such as along arrow E in FIG. 6), toward the juncture of baffle 62 and bottom 19 (such as along arrow F in FIG. 6), toward the underside of baffle 62 (such as along arrow G in FIG. 6), or toward side 18 (such as along arrow H in FIG. 6). Stated another way, in some applications it may be desirable to avoid orienting the flow of electrolyte toward slot 67 along virtually any path from manifold 50.

It should be appreciated that the electrolyte flow rate and other parameters of the electrorefining system of the present invention may be adjusted from time to time to optimize quality and output. For example, if it is determined that a higher flow rate is needed, this can be achieved by either increasing the pressure at the inlet of manifold 50 or, alternatively, manifold 50 may be provided with a plurality of inlet orifices, wherein the number of functioning orifices may be dynamically reconfigured. For example, manifold 50 may be conveniently equipped with any desired number of inlet orifices, some of which are plugged with removable caps. When it is desired to increase or decrease the flow rate for a given inlet fluid pressure, the various orifices may be plugged or unplugged as necessary. Moreover, as fluid flow rate is increased or decreased, the area of slot 67 may be manipulated to control fluid velocity, for example by varying angle $\alpha$ and, hence, the dimension of slot 67.

In this regard and as briefly discussed above, maximum electrolyte flow rate may not necessarily constitute an optimum flow rate. For example, if uniform reagent characteristic distribution is achieved, a substantially uniform flow velocity is established, a substantially constant temperature is maintained, and the slime at the bottom of the tank and on the anode face is relatively undisturbed, it may not be necessary or even desirable to further increase flow rate for a given applied current density. Thus, as long as a sufficiently high flow rate is established for a given current density in view of the aforementioned process parameters (among others), further increasing electrolyte flow rate may not add further value.

Figure 7:
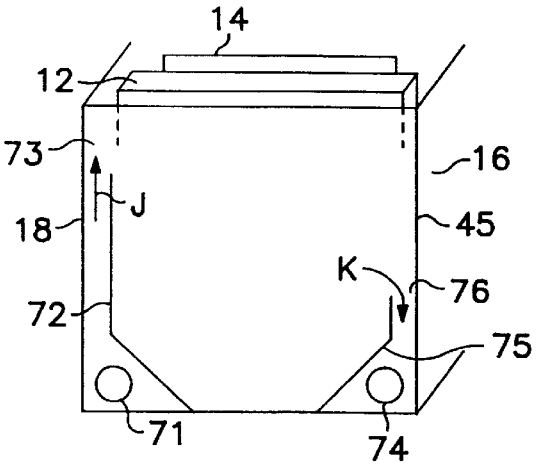
FIG. 7 is a schematic end view of a further alternative embodiment of an electrorefining cell system in accordance with the present invention.

Referring now to FIG. 7, a further embodiment of an improved electrorefining system in accordance with the present invention comprises an inlet and discharge configuration in which the fluid enters the interior of cell 16 from an upper portion of cell 16 and fluid exits the interior of cell from a lower portion of cell 16. More particularly, an elongated inlet manifold 71 (analogous to any of those discussed above, shown here in cross-section) suitably is disposed proximate a baffle 72. Baffle 72 is oriented with respect to the bottom of cell 16 and extends upward substantially parallel and proximate to side wall 18, forming slot 73 at an upper portion of cell 16. Fluid flowing from inlet manifold 71 flows upward along wall 18 and baffle 72 and enters cell 16 through slot 73, creating a flow path as shown by arrow J.

Similarly, discharge manifold 74 (analogous to any of those discussed above, shown here in cross-section) may be conveniently disposed proximate a baffle 75. Baffle 75 preferably is oriented with respect to the bottom of cell 16 and may optionally extend upwardly substantially parallel and substantially proximate to side wall 45, forming a slot 76 at a lower portion of cell 16. Fluid flowing into discharge manifold 74 flows through slot 76 and downward between wall 45 and baffle 75, exiting cell 16 and creating a flow path as generally shown by arrow K. In this way, a substantially uniform flow of electrolyte is achieved throughout cell 16 in an orientation which is substantially parallel to the opposing electrode surfaces.

Figure 8:
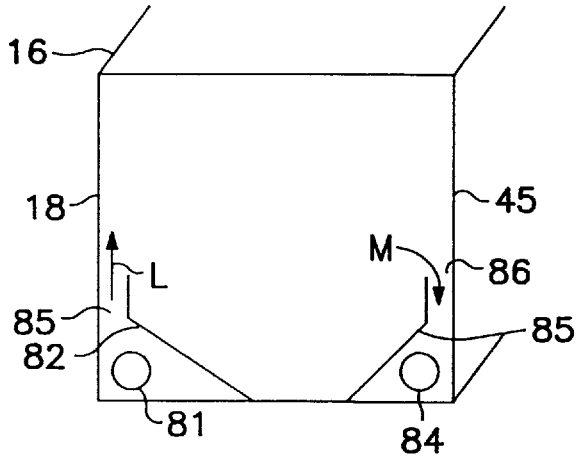
FIG. 8 is a schematic end view of yet a further alternative embodiment of an electrorefining system in accordance with the present invention.

Referring now to FIG. 8, an improved electrorefining system in accordance with yet another aspect of the present invention comprises an inlet and discharge configuration in which the fluid enters and exits the interior of cell 16 from the lower portion of cell 16. Preferably, in accordance with this embodiment, a baffle 82 is oriented with respect to the bottom of cell 16 forming a slot 83 at a lower portion of cell 16. Fluid flowing from inlet manifold 81 (shown in cross-section) enters cell 16 through slot 83 creating a flow path as generally shown by arrow L. Similarly, a second baffle 85 is suitably oriented with respect to the bottom of cell 16 forming a slot 86, also at a lower portion of cell 16. Fluid flowing into discharge manifold 84 (also shown in cross-section) flows through slot 86 creating a flow path as generally shown by arrow M. In this way, a substantially uniform flow, indicated by arrows L and M, of electrolyte is achieved throughout cell 16 in an orientation which is substantially parallel to the opposing electrode surfaces. It should be appreciated that in the context of the embodiments shown in FIGS. 7 and 8, baffles 75, 82 and/or 85 may suitably comprise a baffle analogous to baffle 62 as shown in FIG. 6.

Figure 9:
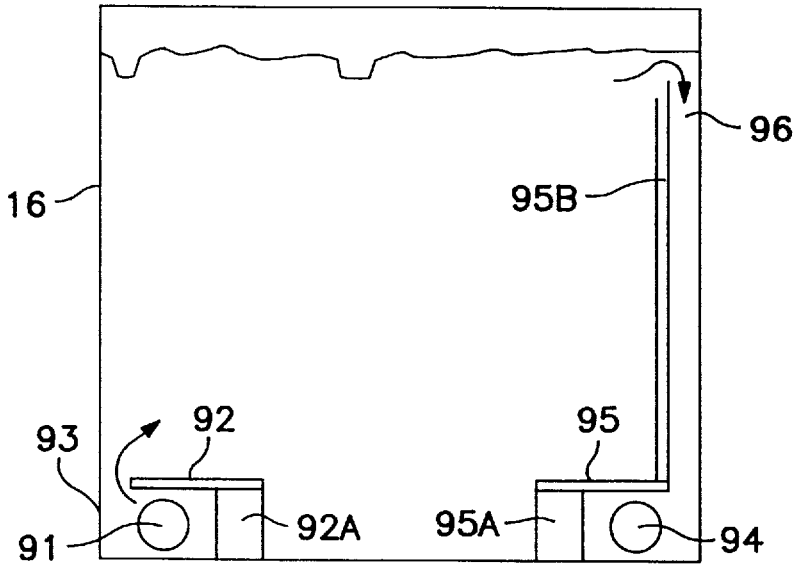
FIG. 9 is a schematic end view of a still further alternative embodiment of an electrorefining system in accordance with the present invention.

Referring now to FIG. 9, a still further alternative embodiment of an electrorefining system in accordance with the present invention is shown. In accordance with this embodiment, cell 16 is provided with an inlet and discharge configuration similar to the configuration illustratively exemplified in connection with FIG. 4. However, in accordance with this embodiment, the inlet and outlet baffles are constructed through use of a substantially block-shaped component. Preferably, in accordance with this embodiment, a fluid inlet slot 93 is formed around an inlet manifold 91 (shown in cross-section) by a first member 92 and a second member 92A; similarly, a discharge slot 96 is formed to communicate with and generally surround a discharge manifold 94 (also shown in cross section) by a first member 95 and a second member 95A. As shown, second members 92A and 95A suitably evidence a substantially rectangular cross-sectional configuration, such as formed by one or more "brides" suitably placed and appropriately aligned along the bottom of cell 16. Second members 92A and 95A suitably protect manifolds 91 and 94, respectively, as well as provide for convenient mounting of first members 92 and 95. As shown in this FIG. 9, first member 95 may be provided with an upstanding extension 95B such that fluid flows in inlet manifold 91 to outlet manifold 94 generally along the direction indicated by the arrows N and O. Alternatively, the baffle systems surrounding manifolds 91 and 94 may be suitably arranged to achieve any desirable flow pattern, such as those described in connection with the previously disclosed embodiments or any other flow pattern evident or hereafter devised by those skilled in the electrorefining art in light of the subject disclosure. As should be appreciated, "bucks" 92A and 95A may be configured to evidence other cross-sectional configurations as may be described in any particular application. Furthermore, the attachment of members 92 and 95 to members 92A and 95A may be in any convenient or conventional manner, such as through the use of fastening devices, adhesives, etc.

The hydraulic systems in accordance with the present invention can accommodate the design considerations discussed herein while satisfactorily delivering electrolyte flow rates in the range of 30 to 250 GPM, and preferably in the range of 50 to 100 GPM, and most preferably around 60 GPM. With flow rates in the 50 to 100 GPM range, temperature differentials between electrolyte inlet and electrolyte discharge are less than 1° F. with ambient air temperatures in the range of 60° to 100° F.

In accordance with a further aspect of the present invention, to the extent flow rates can be increased without disrupting slime layer 24 while at the same time insuring substantially uniform reagent distribution, the residence time of the plating reagents within the cell is concomitantly decreased. In this regard, although some of the plating reagent is consumed in the deposition process, in typical electrorefining systems a greater portion of the plating reagent is simply depleted due to reagent degradation as a result of high residence times. By reducing the residence time of the reagent within the cell, at least some of the reagent loss attributable to degradation tends to be avoided. Thus, a further advantage of the various configurations described herein surrounds the ability to actually decrease the quantity of reagent in the aggregate electrolyte while still maintaining sufficiently high and uniform reagent distribution throughout the electrodes.

In accordance with a further aspect of the present invention, substantially higher flow rates may be achieved while maintaining fluid velocities in the vicinity of the inlet and discharge slots within acceptable ranges, for example on the order of 20 to 40 feet per minute (fpm), and most preferably about 24 fpm with fluid flow rates on the order of 60 GPM. As discussed above, by maintaining fluid velocity levels in the cell within acceptable ranges, the potential for slime disruption may be minimized.

Although the subject invention has been described herein in conjunction with the appended drawing figures, those skilled in the art will appreciate that the scope of the invention is not so limited. Various modifications in the design and arrangement of the components discussed and the steps described herein for implementing the various features of the invention may be made without departing from the scope of the invention as set forth in the appended claims.

What is claimed is:

1. A method for electrorefining a metal, comprising the steps of:

providing a cell having an alternating series of anodes and cathodes disposed therein;

providing an elongated inlet manifold disposed lengthwise within said cell;

providing a plurality of inlet orifices disposed along the length of said inlet manifold, wherein an electrolyte solution is pumped through said plurality of inlet orifices; and providing a first baffle configured to be substantially impermeable to said electrolyte solution, wherein said first baffle substantially shrouds said inlet manifold to direct flow of said aqueous electrolyte solution out of said inlet manifold and wherein a first elongated slot, positioned along the length of said inlet manifold, is formed between said first baffle and a first side wall of said cell such that said inlet slot resides below the surface of said electrolyte solution within said cell to thereby allow said electrolyte solution to flow through said inlet slot and into said cell.

2. The method of claim 1 further comprising the steps of providing an elongated outlet manifold disposed lengthwise within said cell; and providing a second baffle configured to be substantially impermeable to said electrolyte solution, wherein said second baffle substantially shrouds said outlet manifold and a second elongated slot is formed between said second baffle and a second side wall of said cell.

3. The method of claim 2 further comprising the step of providing a plurality of outlet orifices disposed along the length of said outlet manifold, wherein said electrolyte solution is withdrawn through said plurality of outlet orifices.

4. An improved electrorefining system comprising:

a cell having an alternating series of anodes and cathodes disposed therein;

an inlet port disposed in a first side of said cell;

an electrolyte inlet manifold, wherein said electrolyte inlet manifold communicates with said inlet port to thereby introduce an aqueous electrolyte solution into said cell;

a first substantially fluidly impermeable baffle disposed to substantially shroud said electrolyte inlet manifold and configured to direct flow of said electrolyte solution out of said inlet manifold, said first baffle and said first side of said cell defining an elongate inlet slot therebetween, said inlet slot being positioned along the length of said inlet manifold;

an outlet port disposed in a second side of said cell;

an electrolyte discharge manifold, wherein said electrolyte discharge manifold communicates with said outlet port; and a second substantially fluidly impermeable baffle disposed to substantially shroud said electrolyte discharge manifold, said second baffle and said second side of said cell defining an elongate discharge slot therebetween;

wherein said inlet slot is configured to reside below the surface of said aqueous electrolyte solution within said cell; and said aqueous electrolyte solution flows from said inlet manifold, through said inlet slot, and into said cell.

5. The electrorefining system of claim 4 wherein said electrolyte inlet manifold includes a plurality of inlet orifices configured to introduce said electrolyte solution into said cell.

6. The electrorefining system of claim 5 wherein said electrolyte inlet manifold has a surface area and each of said plurality of inlet orifices defines an aperture area, the surface area of said electrolyte inlet manifold being greater than the sum of the aperture areas defined by each of said plurality of inlet orifices.

7. The electrorefining system of claim 5 wherein said electrolyte discharge mainfold includes a plurality of orifices each of said orifices having a diameter, said diameter being greater than a diameter of said inlet orifices.

8. The electrorefining system of claim 4, wherein said inlet manifold and said discharge manifold are each located proximate a bottom of said cell.

9. An improved method for refining a metal comprising the steps of:

providing an inlet port disposed in a first side of a cell for receiving an electrolyte solution;

providing an inlet manifold in fluid communication with said inlet port, said inlet manifold having a plurality of inlet orifices formed therein;

substantially shrouding said plurality of inlet orifices with a first baffle substantially impermeable to said electrolyte solution and configured to define an elongated inlet slot positioned over the length of said inlet manifold between a first side wall of said cell, said inlet slot being configured to reside below the surface of said electrolyte solution within said cell;

transporting said electrolyte solution from said inlet port to said plurality of inlet orifices;

directing said electrolyte solution from said inlet orifices, through said inlet slot, and into said cell;

providing an outlet port disposed in a second side of said cell;

providing an outlet manifold in fluid communication with said outlet port; and discharging said electrolyte solution through said outlet port.

10. The method of claim 9 wherein said electrolyte solution flows through said cell in the range of about 30 to about 250 GPM, and a difference between a temperature of said electrolyte solution at said discharge manifold and a temperature of said electrolyte solution at said inlet manifold is less than about 1° F.

11. An improved electrorefining system of the type comprising a cell having an alternating series of anodes and cathodes, an inlet for receiving an electrolyte solution and an outlet for exiting of said electrolyte solution as said electrolyte solution is pumped through said cell, said cell in operation having a slime layer at the bottom thereof and on at least one anode face, improved wherein said cell includes means for increasing electrolyte flow through said cell while maintaining the slime layers substantially intact, said means for increasing electrolyte flow comprising:

a baffle substantially impermeable by said electrolyte solution and disposed to substantially shroud an electrolyte inlet manifold;

an inlet slot formed between said baffle and a side wall of said cell and positioned over the length of said inlet manifold, said inlet slot being configured to reside below the surface of said electrolyte solution within said cell; wherein said baffle is shaped to direct flow of said electrolyte solution out of said inlet manifold, through said inlet slot, and into said cell.

12. An improved electrorefining system of the type having a cell containing an alternating series of anodes and cathodes, the system comprising:

an elongated electrolyte inlet manifold configured to introduce an aqueous electrolyte solution into said cell; and a first baffle substantially impermeable by said electrolyte solution and disposed to substantially shroud said electrolyte inlet manifold to thereby define an elongate inlet slot positioned alone the length of said electrolyte inlet manifold between said first baffle and a first wall of said cell, said inlet slot being configured to reside below the surface of said electrolyte solution within said cell; wherein said baffle is configured to direct flow of said aqueous electrolyte solution out of said inlet manifold, through said inlet slot, and into said cell.

13. The electrorefining system of claim 12 further comprising an electrolyte discharge manifold, and a second baffle substantially impermeable by said electrolyte solution and disposed to substantially shroud said electrolyte discharge manifold.

14. The electrorefining system of claim 13 further comprising an inlet port which communicates with said electrolyte inlet manifold, and an outlet port which communicates with said electrolyte discharge manifold.

15. The electrorefining system of claim 13 wherein said first baffle and said second baffle are each oriented with respect to a bottom of said cell so as to define an angle in the range of about 30 to about 60 degrees, said angle being associated with flow parameters of said electrolyte solution.

16. The electrorefining system of claim 13 further comprising an elongated discharge slot formed between said second baffle and a second side wall of said cell and wherein a distance from a bottom of said cell to said elongated discharge slot is greater than a distance from said bottom of said cell to said elongated inlet slot.

17. The electrorefining system of claim 16 wherein the electrolyte solution flows in a direction substantially parallel to the anodes and cathodes in the cell.

18. The electrorefining system of claim 12 wherein said electrolyte inlet manifold comprises a plurality of inlet orifices through which said aqueous electrolyte solution flows.

19. The electrorefining system of claim 18 wherein said plurality of inlet orifices are disposed along the length of said inlet manifold, each of said plurality of inlet orifices being spaced substantially equidistantly from an adjacent inlet orifice.

20. The electrorefining system of claim 18 wherein each of said plurality of inlet orifices has a diameter, the diameter being on the order of about 0.125 to about 1 inch.

21. The electrorefining system of claim 18 wherein said electrolyte inlet manifold has a surface area and each of said plurality of inlet orifices defines an aperture area, the surface area of said electrolyte inlet manifold being greater than the sum of the aperture areas defined by each of said plurality of inlet orifices.

22. The electrorefining system of claim 21 wherein said electrolyte discharge manifold includes a plurality of outlet orifices, each of said outlet orifices having a substantially uniform diameter, the diameters of said outlet orifices being greater than a diameter of said inlet orifices.

23. The electrorefining system of claim 12 wherein said electrolyte inlet manifold spans substantially the length of said cell near a bottom of said first wall.

24. The electrorefining system of claim 12 wherein said electrolyte inlet manifold has an inner diameter on the order of about 1 to about 2 inches.

* * * * *

UNITED STATES PATENT AND TRADEMARK OFFICE

CERTIFICATE OF CORRRECTION

PATENT NO. : 5,855,756
DATED : January 5, 1999
INVENTOR(S) : Gerald C. Anzalone,III It is certified that error appears in the above-identified patent and that said Letters Patent is hereby corrected as shown below:

Title page, item [56] insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 4 | 2 | 8 | 2 | 0 | 8 | 2 | 8/4/81 | Cook et al. | | | |
| | | | | | | | | | | | | | |

Signed and Sealed this

Sixth Day of April, 1999

*Attest:*

*Attesting Officer*

Q. TODD DICKINSON

*Acting Commissioner of Patents and Trademarks*